US005607290A

United States Patent [19]

Duncan

[11] Patent Number: 5,607,290

[45] Date of Patent: Mar. 4, 1997

[54] AIR DRIVEN DIAPHRAGM PUMP

[75] Inventor: Gregory S. Duncan, Corona, Calif.

[73] Assignee: Wilden Pump & Engineering Co., Grand Terrace, Calif.

[21] Appl. No.: 554,726

[22] Filed: Nov. 7, 1995

[51] Int. Cl.[6] ..... F04B 17/00

[52] U.S. Cl. ..... 417/393; 417/395; 91/DIG. 2; 137/625.63

[58] Field of Search ..... 417/313, 393, 417/395; 91/467, 468, DIG. 2; 137/625.63, 625.69; 251/118

[56] References Cited

U.S. PATENT DOCUMENTS

| | | | |
|---|---|---|---|
| 4,247,264 | 1/1981 | Wilden | 417/393 |
| 4,406,596 | 9/1983 | Budde | 91/436 |
| 4,549,467 | 10/1985 | Wilden et al. | 91/307 |
| 4,586,535 | 5/1986 | Stoll | 137/102 |
| 4,854,832 | 8/1989 | Gardner et al. | 417/393 |
| 5,169,296 | 12/1992 | Wilden | 417/395 |
| 5,213,485 | 5/1993 | Wilden | 417/393 |
| 5,366,353 | 11/1994 | Hand | 417/375 |

*Primary Examiner*—Charles G. Freay
*Attorney, Agent, or Firm*—Lyon & Lyon

[57] ABSTRACT

A pump having a center section including an actuator housing and an air valve is arranged with air chambers to either side of the actuator housing. Diaphragms are associated with the air chambers to create enclosed cavities for alternately pressurizing and venting the diaphragms. The actuator uses a pilot shifting shaft which is shuttled by movement of the diaphragms. An air valve is controlled by the shuttle shifting shaft to control flow to and from the air chambers. The passageways from the air chambers to exhaust find the passage to the outlet being at least as restrictive to air flow as the remainder of the passageways so as to prevent major pressure decreases within the actuator body. A diffuser includes a thin space between two surfaces into which the exhaust is directed. One of the surfaces is associated with a porous block of material. Exhausting air is distributed within the space and then passed through the porous block of material. The cylindrical orifice through which flow radially passes is roughly the same cross section as the restricted exhaust passageway. The air valve includes a cylinder closed at one end with an end cap positioned at the other end. The end cap is arranged with a plug that fits within the cylinder so as to seal without close tolerance on axial positioning. Bolts retaining the air valve and the actuator housing also retain the end cap as well.

21 Claims, 6 Drawing Sheets

AIR DRIVEN DIAPHRAGM PUMP

BACKGROUND OF THE INVENTION

The field of the present invention is pumps and actuators for pumps having air driven diaphragms.

Pumps having double diaphragms driven by compressed air directed through an actuator valve are well known. Reference is made to U.S. Pat. Nos. 5,213,485; 5,169,296; and 4,247,264; and to U.S. Pat. Nos. Des. 294,946; 294,947; and 275,858. An actuator valve using a feedback control system is disclosed in U.S. Pat. No. 4,549,467. The disclosures of the foregoing patents are incorporated herein by reference.

Common to the aforementioned patents on air driven diaphragm pumps is the presence of an actuator housing having air chambers facing outwardly to cooperate with pump diaphragms. Outwardly of the pump diaphragms are pump chamber housings with inlet manifolds and outlet manifolds. Ball check valves are also positioned in both the inlet passageways and the outlet passageways. The actuator between the air chambers includes a shaft running therethrough which is coupled with the diaphragms. An air valve controls flow to alternate pressure and exhaust to and from each of the air chambers so as to result in reciprocation of the pump. The air valve is controlled by a pilot system controlled in turn by the position of the pump diaphragms. Thus, a feedback control mechanism is provided to convert a constant air pressure into a reciprocating distribution of pressurized air to each air chamber. A vast range of materials are able to be pumped safely and efficiently using such systems.

Air driven systems, using the expansion of compressed gasses to convert potential energy into work, can experience problems of icing when there is moisture in the compressed gas. As the gas expands, it cools and is unable to retain as much moisture. The moisture condensing from the cooled gas can collect in the passageways and ultimately form ice. This can result in less efficient operation and stalling.

SUMMARY OF THE INVENTION

The present invention is directed to an air driven diaphragm pump and to actuators therefor minimizing icing.

In a first, separate aspect of the present invention, an air driven diaphragm pump having an air valve and air chamber passages is designed such that the exhaust passage is at least as restrictive as the remaining passageways leading from the air chamber. As a result, the majority of the expansion occurs beyond the exhaust passage. The cooling effect of expanding air is reduced and, in turn, icing is reduced.

In a second, separate aspect of the present invention, an air driven diaphragm pump having passageways from the air chambers venting to atmosphere includes a diffuser providing first and second closely spaced surfaces with at least one of the surfaces being porous and with the exhaust from the air driven diaphragm pump communicating with that space in a substantially perpendicular manner. The diffuser allows for a distribution of expanding gases from a constrained area with a redirection of the flow. This configuration can assist in providing reduced icing within the actuator.

In a third, separate aspect of the present invention, an air driven diaphragm pump includes an actuator housing and an air valve which are held together by fasteners. The air valve includes a valve cylinder having a cylindrical bore closed at one end. An end cap having a plug with an O-ring thereabout closely mates with the valve cylinder and accommodates some of the fasteners to hold the end cap in place. This arrangement provides for a minimum number of parts and easy assembly.

In a fourth, separate aspect of the present invention, combinations of the foregoing aspects are also contemplated as are the foregoing features in association with an actuator for other air driven reciprocal devices.

Accordingly, it is a principal object of the present invention to provide an improved actuator system for reciprocal air driven devices including pumps. Other and further objects and advantages will appear hereinafter.

DETAILED DESCRIPTION OF THE PREFERRED EMBODIMENT

Figure 1:
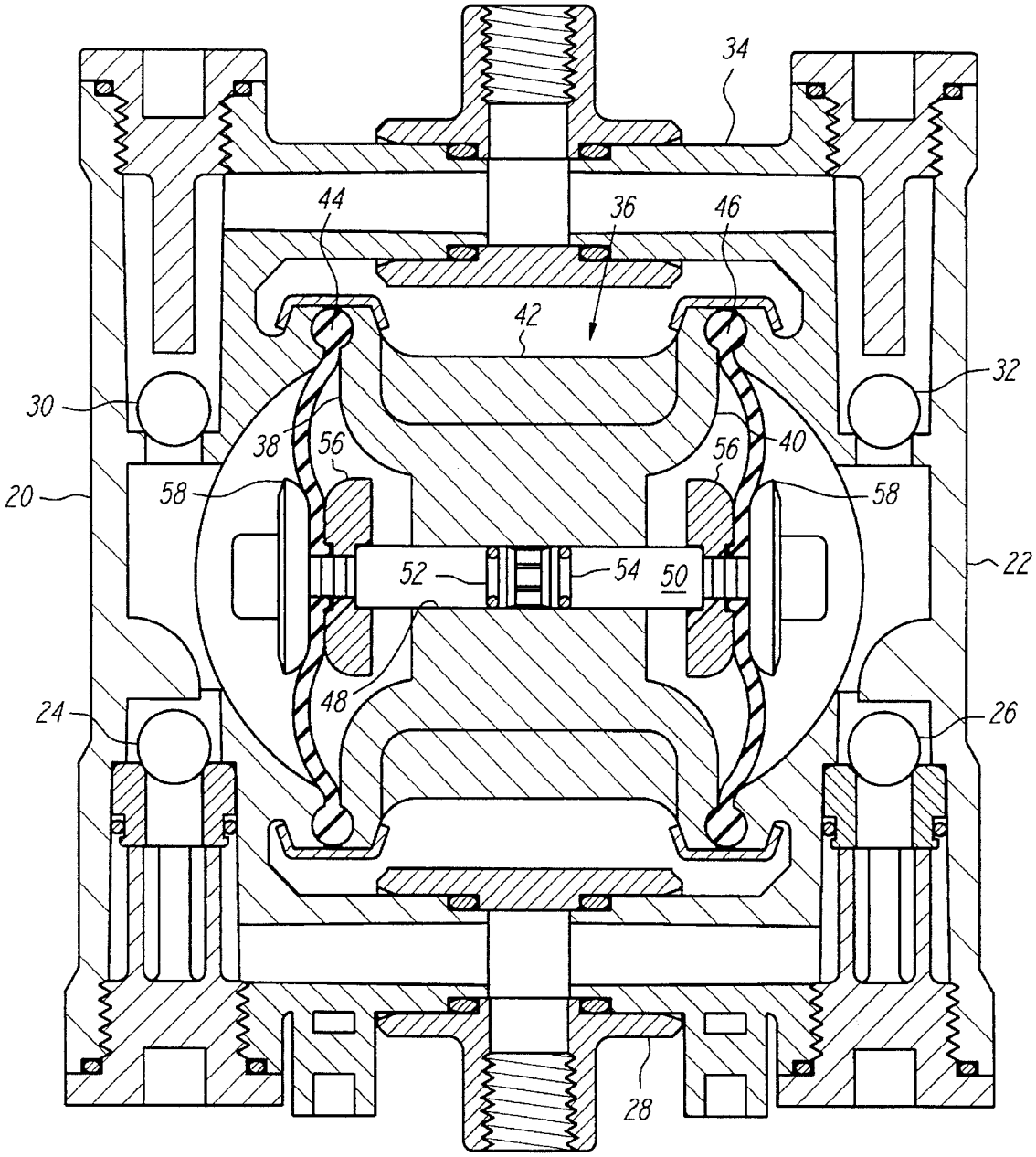
FIG. 1 is a cross section of an air driven diaphragm pump.
Figure 2:
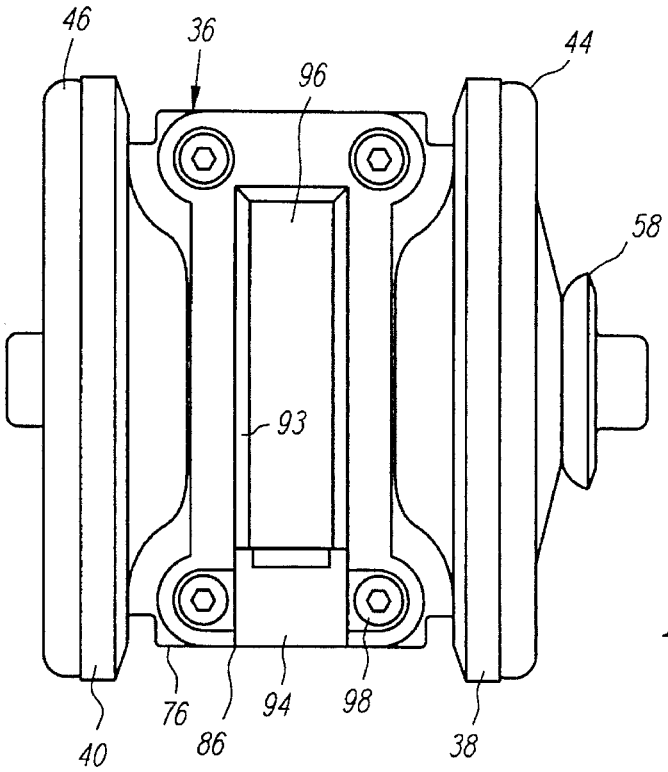
FIG. 2 is a top view of an air valve with diaphragms in place.
Figure 3:
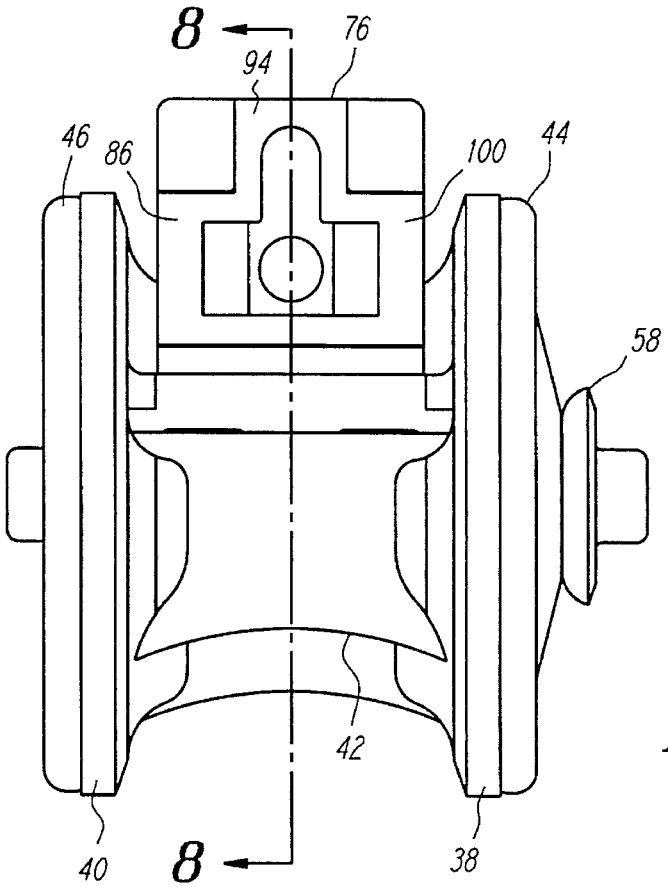
FIG. 3 is a side view of the assembly of FIG. 2.
Figure 4:
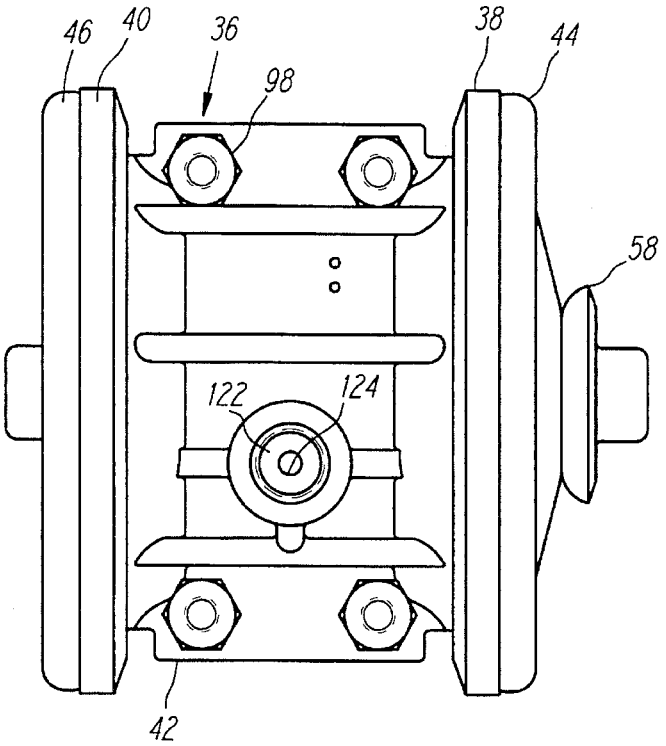
FIG. 4 is a bottom view of the assembly of FIG. 2.
Figure 5:
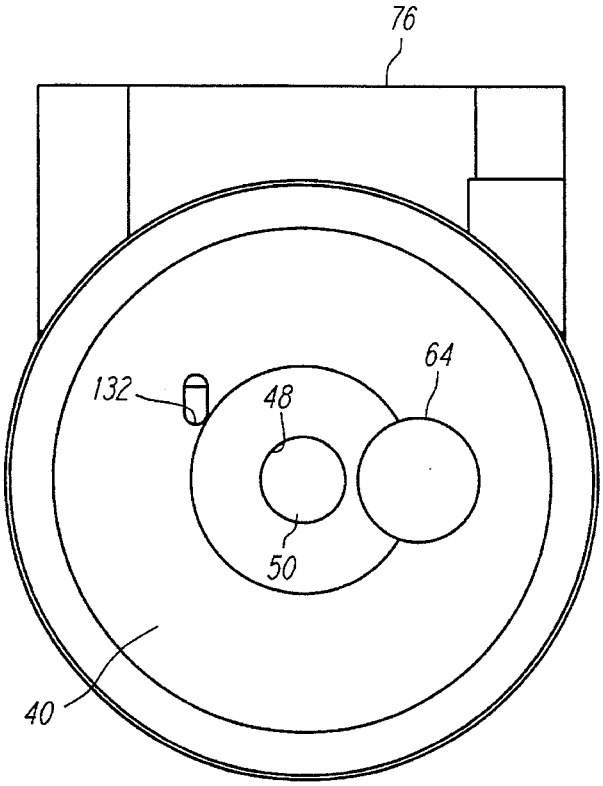
FIG. 5 is a left side view of the assembly of FIG. 2 with the diaphragms removed.
Figure 6:
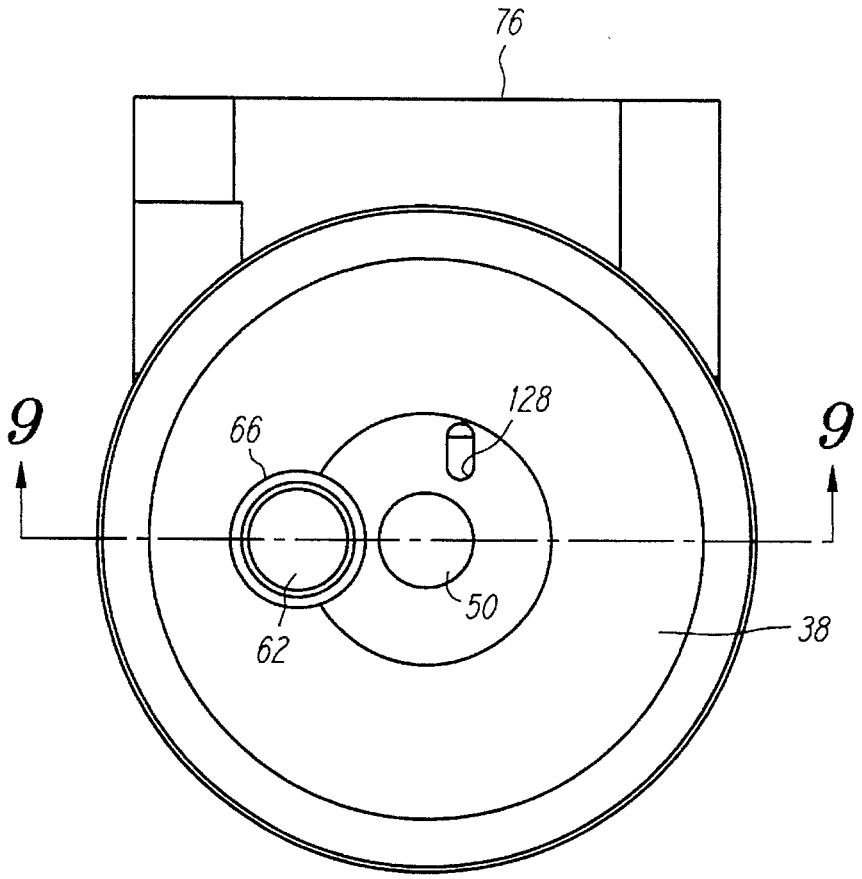
FIG. 6 is a right side view of the assembly of FIG. 2 with the diaphragms removed.

Turning in detail to the drawings, FIG. 1 illustrates an air driven double diaphragm pump, illustrated in cross section for clarity. The pump structure includes two pump chamber housings 20 and 22. These pump chamber housings 20 and 22 each include a concaved inner side forming pumping cavities through which the pumped material passes. One-way ball valves 24 and 26 are at the lower end of the pump chamber housings 20 and 22, respectively. An inlet manifold 28 distributes material to be pumped to both of the one-way ball valves 24 and 26. One-way ball valves 30 and 32 are positioned above the pump chambers 20 and 22, respectively, and configured to provide one-way flow in the same direction as the valves 24 and 26. An outlet manifold 34 is associated with the one-way ball valves 30 and 32.

Inwardly of the pump chambers 20 and 22, a center section, generally designated 36, includes air chambers 38 and 40 to either side of an actuator housing 42. There are two pump diaphragms 44 and 46 arranged in a conventional manner between the pump chambers 20 and 22 and the air chambers 38 and 40, respectively. The pump diaphragms are retained about their periphery between the corresponding peripheries of the pump chambers 20 and 22 and the air chambers 38 and 40.

Figure 9:
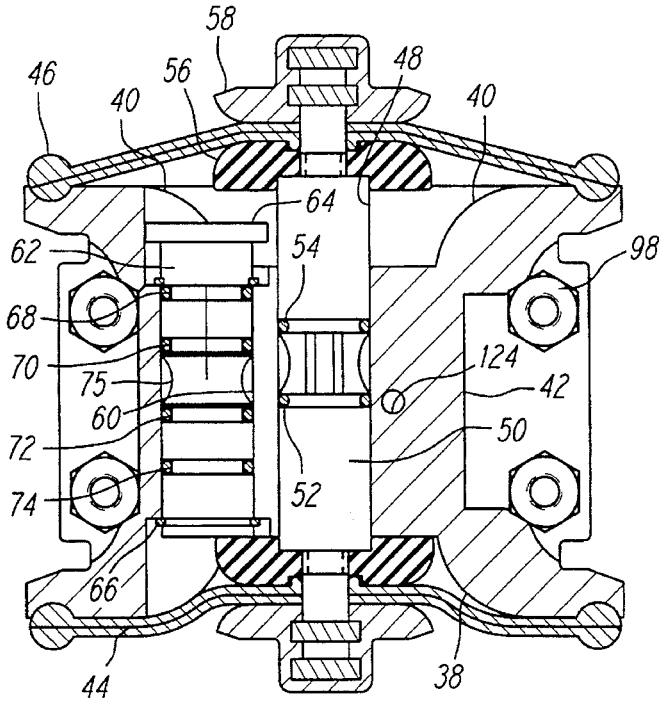
FIG. 9 is a cross-sectional view taken along line 9—9 of FIG. 6.

The actuator housing 42 provides a first guideway 48 which is concentric with the coincident axes of the air chambers 38 and 40 and extends to each air chamber. A shaft 50 is positioned within the first guideway 48. The shaft 50 provides channels for O-rings 52 and 54 as a mechanism for sealing the air chambers 38 and 40, one from another along the guideway 48. The shaft 50 includes piston components 56 and 58 on each end thereof. These components 56 and 58 capture the centers of each of the pump diaphragms 44 and 46 as best illustrated in FIG. 9. The shaft 50 causes the pump diaphragms 44 and 46 to operate together to reciprocate within the pump.

Also located within the actuator housing 42 is a second guideway 60 within which a pilot shifting shaft 62 is positioned. The guideway extends fully through the center section to the air chambers 38 and 40. The pilot shifting shaft 62 extending through the second guideway 60 also extends beyond the actuator housing 42 to interact with the piston components 56. A head 64 and a clip ring 66 retain the pilot shifting shaft 62 from travelling excessively in either axial direction. As can be seen in FIG. 9, the pilot shifting shaft 62 extends into the path of travel of the inner piston components 56. Thus, as the shaft 50 reciprocates, the pilot shifting shaft 62 is driven back and forth. The pilot shifting shaft 62 includes channels for four O-rings 68, 70, 72 and 74. The outer O-rings 68 and 74 provide sealing between the guideway 60 and the air chambers 38 and 40. The inner O-rings 70 and 72 seal an axial passage 75 of reduced diameter in the shaft 62.

Associated with the actuator housing 42 is an air valve 76. The air valve 76 includes a valve cylinder 78. The valve cylinder 78 includes a cylindrical bore 80 extending partially therethrough such that the bore 80 is closed at one end by the body of the valve cylinder 78. The cylindrical bore 80 may be divided into two sections, section 82 is of a smaller diameter than section 84. The cylindrical bore 80 is closed at the end of the large section 84 by an end cap 86. The end cap 86 includes a cylindrical plug 88 which extends into the large section 84 of the cylindrical bore 80. An O-ring 90 is arranged about the plug 88 to seal with the cylindrical bore 80. Because the O-ring 90 is about the plug 88, the sealing occurs without regard for how completely the plug 88 seats in the cylindrical bore 80.

Also associated with the actuator housing 42 is an open diffuser cavity 92. The open diffuser cavity 92 is positioned above the valve cylinder 78, providing a rectangular cavity closed on three sides with retainer flanges 93 extending into the open cavity 92. The open end of the cavity 92 is closed by an upwardly extending portion 94 of the end cap 86. The diffuser cavity 92 includes a porous block of material 96 which may be slid into the cavity 92 beneath the retainer flanges 93 and held in place by the upwardly extending portion 94 of the end cap 86.

The air valve 76 is retained on the actuator housing 42 by four fasteners 98. The fasteners 98 adjacent the end cap 86 retain the end cap 86 in position as well as compress the air valve 76 against the actuator housing 42. The end cap 86 includes extensions 100 positioned within cavities in the air valve 76. The extensions 100 include holes to receive the fasteners 98. To locate the air valve 76 on the actuator housing 42, pins 101 on the air valve 76 fit within locator holes 102 on the actuator housing 42.

The air valve 76 includes a valve piston, generally designated 104, which is positioned within the valve cylinder 78 in the cylindrical bore 80. The valve piston 104 includes a large piston end 106 having an O-ring 108 in a receiving channel. The large piston end 106 fits closely within the large section 84 of the cylindrical bore 80. A small raised portion 110 insures an annular space between the end of the valve piston 104 and the plug 88 with the valve piston 104 positioned toward the large end 106.

The valve piston 104 also includes a piston body 112 which is smaller in diameter than the large piston end 106. The piston body 112 includes four O-rings 114, 115, 116 and 117. Between the O-rings 114 and 115 the piston body 112 is reduced in diameter to provide an axial passage 118 for the flow of air. The piston body 112 includes another axial passage 119 where the diameter is also reduced between the O-rings 115 and 116. A small piston 120 is defined at the end of the piston body 112. The O-ring 117 seals the bore around the piston 120. A small raised portion 121 on the small piston 120 insures an annular space at that end with the valve piston 104 positioned toward the small end of the cylindrical bore 80.

Figure 7:
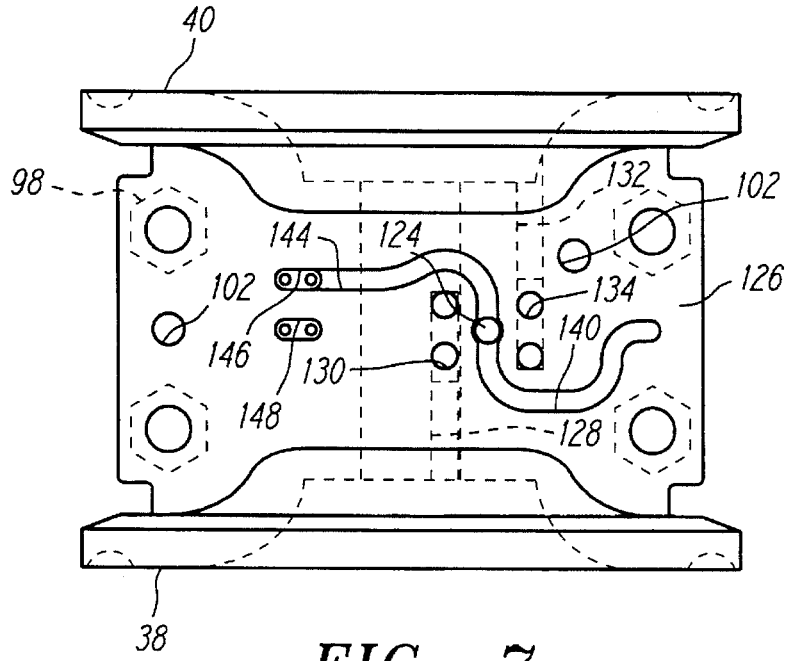
FIG. 7 is a plan view of the actuator housing with the air valve removed for clarity.

To appropriately describe the passageways within the actuator housing 42 and the air valve 76, reference will also be made to the operation of the system. An inlet 122 is provided on one side of the actuator housing 42 and extends by an inlet passage 124 through to the face 126 of the actuator housing 42, as seen in FIG. 7, which mates with the air valve 76. The inlet passage 124 extends across the face 126 and through the valve cylinder 78 to the cylindrical bore 80.

Figure 8:
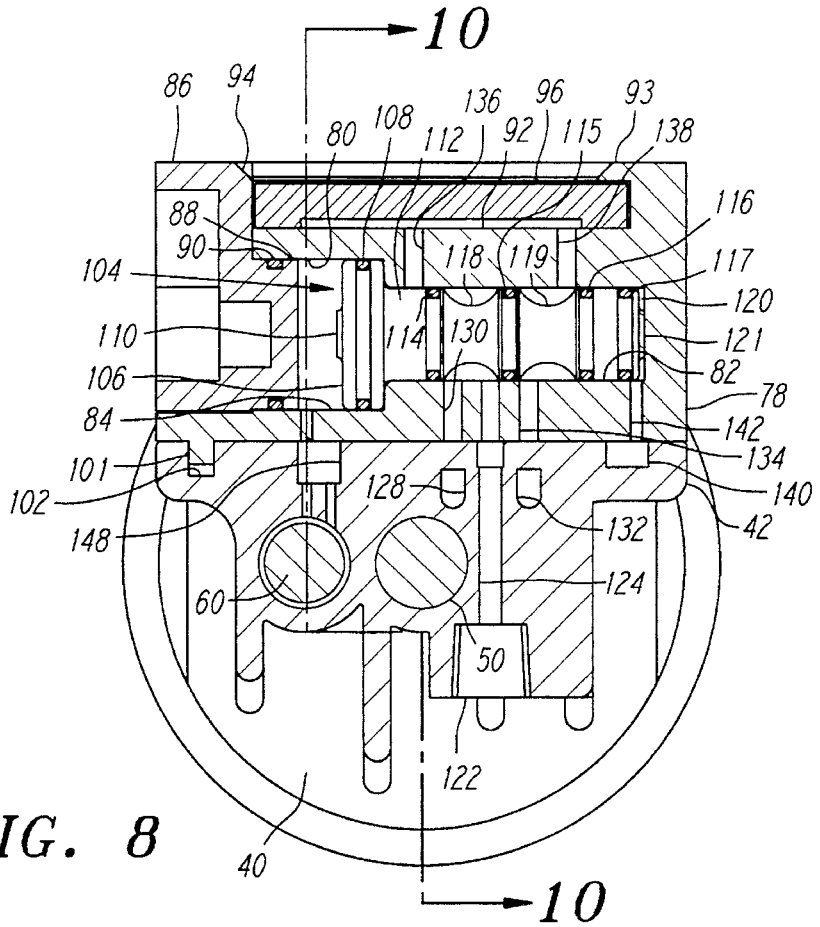
FIG. 8 is a cross-sectional view taken along line 8—8 of FIG. 3.

The location of the valve piston 104 at the extreme positions within the cylindrical bore 80 dictates the communication of the inlet passage 124 with the air chambers 38 and 40. As seen in FIG. 8, the inlet 122 is in communication with the axial passage 118 of the piston body 112 between the O-rings 114 and 115. The axial passage 118 is also in communication with an air chamber passage 128. Thus, the inlet pressure is communicated with the air chamber passage 128. The air chamber passage 128 extends downwardly through the valve cylinder 78 and then laterally to the air chamber 38. As can be seen from FIG. 7, there are two ports 130 extending downwardly to the passage 128. Were the valve piston 104 positioned at the other extreme within the valve cylinder 78, the inlet passage 124 would communicate with the axial passage 119 of the piston body 112 between the O-rings 115 and 116. In this way, the inlet passage 124 would be in communication with the air chamber passage 132 through ports 134. The air chamber passage 132 communicates with the air chamber 40, as also seen in FIG. 7.

Extending upwardly through the valve cylinder 78 from the cylindrical bores 80 are exhaust passages 136 and 138. As can be seen in FIG. 8, when the valve piston 104 is positioned toward the small end, the air chamber passage 132 is in communication with the exhaust passage 138. With the valve piston 104 positioned toward the large end, the air chamber passage 128 is in communication with the exhaust passage 136. Thus, with the valve piston 104 positioned toward the small end, pressurized air is provided to the air chamber 38; and the air chamber 40 is opened to exhaust. The reverse is true with the valve piston 104 at the other end. By reciprocating the valve piston 104, the pump is driven to reciprocate as well.

To reciprocate the valve piston 104, the differential areas of the two ends of the valve piston 104 are employed. With reference to FIG. 7, the inlet passage 124 communicates with a passageway 140 which, as seen in FIG. 8, communicates with a passage 142 extending through the valve cylinder 78 to the small end of the valve piston 104. This communication between the small piston 120 and the inlet 122 is always open.

Figure 10:
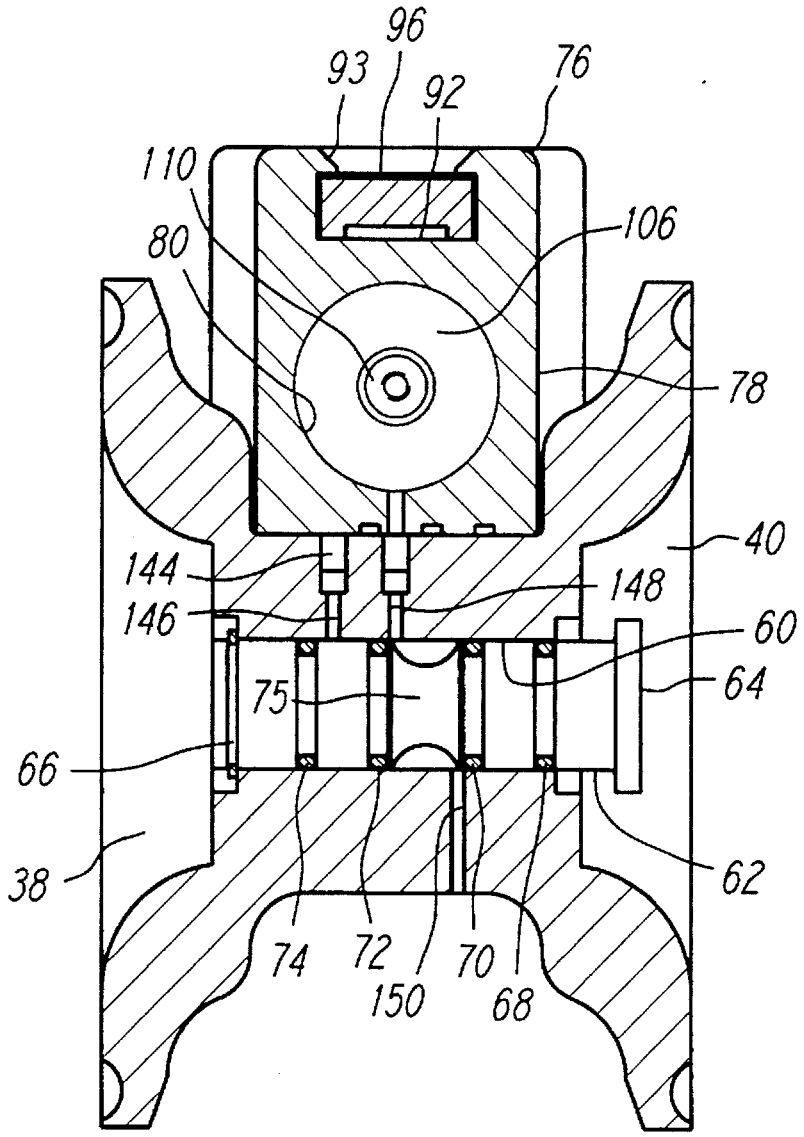
FIG. 10 is a cross-sectional view taken along line 10—10 of FIG. 8.

Also associated with the inlet passage 124 is a passageway 144 as best seen in FIG. 7. This passageway 144 extends to a passage 146 extending through the actuator housing 42 to the second guideway 60 as best seen in FIG. 10. The passage 146 is controlled by the O-ring 72. As the pilot shifting shaft 62 moves from one extreme position to the other, the O-ring 72 crosses the passage 146 to provide communication to the axial passage 75 between the O-rings 70 and 72. This axial passageway communicates the passage 146 with a further passage 148 extending to the large end of the cylindrical bore 80. Thus, communication between the inlet 122 and the large end of the cylindrical bore 80 is controlled by the pilot shifting shaft 62. With the pilot shifting shaft 62 in the position as illustrated in FIG. 10, an exhaust passage 150 is in communication with the passage 148 to vent the large end of the cylindrical bore 80.

With the small end of the valve piston 104 always pressurized and the large piston end 106 controlled by the pilot shifting shaft 62, the location of the valve piston 104 may be controlled. When both ends of the valve piston 104 are pressurized, the larger end experiences more force. Consequently, the valve piston 104 moves to the small end in the position as illustrated in FIG. 8. When the pressure on the large piston end 106 is released by movement of the pilot shifting shaft 62, the pressure on the small end then dominates and forces the valve piston 104 toward the large end.

The pilot shifting shaft 62 determines the direction of pumping. Assuming that the pilot shifting shaft 62 is in a position such as illustrated in FIG. 10 where the large piston end 106 is vented, the valve piston 104 will be forced toward the large end by the continuous pressure exerted on the small end thereof. This is the position opposite to that shown in FIG. 8. Under this circumstance, the air chamber 40 is in communication with the inlet passage 124 and the air chamber 38 is in communication with the exhaust passage 136. Thus, the pump will operate to move the diaphragms 44 and 46 until the piston component 56 of the diaphragm 44 contacts the end of the pilot shifting shaft 62 with the clip ring 66. As the O-ring 72 crosses over the passage 146, to signal completion of the diaphragm stroke, the large end of the cylindrical bore 80 is pressurized. Pressurization of the large end of the cylindrical bore 80 causes the valve piston 104 to shift such that flow is reversed to the air chambers 38 and 40. This condition then exists until the pilot shifting shaft 62 is again shifted by an inner piston component 56.

The configurations of the various passageways are designed to avoid the formation of ice. To accomplish this, expansion of compressed gas is controlled. To this end, the exhaust passages 136 and 138 are arranged to be the most restrictive as to air flow in the series of passages communicating exhausting flow from either of the air chambers 38 and 40. Consequently, the principal pressure drop occurs at the exit rather than in the body of the actuator housing 42 or the air valve 76.

The diffuser also contributes to pressure dissipation in a way not conducive to the formation of ice. The porous block 96 is preferably a block of sintered plastic having 30 micron pore size. The block 96 is displaced from the air valve 76 at the ends of the exhaust passages 136 and 138 as best seen in FIG. 8. The air valve 76 provides a first surface roughly normal to the exhaust passageways 136 and 138. The block of porous material 96 provides a second surface which is opposed to the first surface and closely spaced thereto.

Empirical testing has demonstrated that the proximity of the two surfaces is of importance. With the surfaces spaced too closely together, flow radially from the end of the exhaust passages 136 and 138 is greatly reduced and flow directly through the porous block of material 96 is soon cut off by the accumulation of ice. Spacing the surfaces too far apart allows for full expansion very rapidly at the outlets to the exhaust passages 136 and 138 with quiescent areas within the space between the surfaces to accumulate ice until flow is again blocked. By selecting a spacing providing an annular orifice at the end of the exhaust passages 136 and 138 roughly equal in cross-sectional area to the cross-sectional area of the passages 136 and 138, distribution into the diffuser radially from the ends of the passages 136 and 138 and then through the porous block of material 196 is at maximum efficiency in the preferred embodiment. The cross section of the annular orifice is determined by the spacing between surfaces times the circumference of the exhaust passage 136 or 138 at the intersection with the surface of the air valve 76. The cross section of the exhaust passage 136 or 138 is the cross-sectional area at the intersection of the exhaust passage with the surface of the air valve 76.

Thus, an improved actuation system for and in combination with an air driven diaphragm pump has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven diaphragm pump comprising an actuator having a housing including opposed air chambers and air chamber passages, an air valve, the air chamber passages extending from each air chamber, respectively, to the air valve, and an exhaust passage extending from the air valve to atmosphere, the exhaust passage being at least as restrictive to air flow as each of the air chamber passages and as the air valve;

pump diaphragms extending across each air chamber, respectively, forming enclosed cavities.

2. The air driven diaphragm pump of claim 1, the exhaust passage being more restrictive to air flow than each of the air chamber passages and more restrictive to air flow than the air valve.

3. The air driven diaphragm pump of claim 1 further comprising a diffuser including a first surface on the air valve and a porous, second surface opposed to the first surface, the exhaust passage extending through and being substantially normal to the first surface, the first surface and the second surface being spaced to provide a resistance to air flow at the exhaust passage which is substantially that of the resistance to air flow of the exhaust passage.

4. The air driven diaphragm pump of claim 3, the first surface and the second surface being spaced to provide a cylindrical orifice area substantially equal to the cross-sectional; area of the exhaust passage.

5. An air driven diaphragm pump comprising an actuator including opposed air chambers and air chamber passages, an air valve, the air chamber passages extending from each air chamber, respectively, to the air valve, and an exhaust passage extending from the air valve to atmosphere;

pump diaphragms extending across each air chamber, respectively, forming enclosed cavities;

a diffuser including a first surface and a second surface opposed to the first surface, at least one of the first surface and the second surface being porous, the exhaust passage extending through and being substantially normal to one of the first surface and the second surface, the first surface and the second surface being spaced to provide a resistance to air flow at the exhaust passage which is substantially that of the resistance to air flow of the exhaust passage.

6. The air driven diaphragm pump of claim 5, the first surface being one side of the air valve, the second surface being porous.

7. The air driven diaphragm pump of claim 6, the diffuser including a block of porous material, the second surface being one side of the block.

8. The air driven diaphragm pump of claim 5, the first surface and the second surface being spaced to provide a cylindrical orifice area substantially equal to the cross-sectional; area of the exhaust passage.

9. An air driven diaphragm pump comprising an actuator including an actuator housing having opposed air chambers and air chamber passages, an air valve having a valve cylinder and an open diffuser cavity, the air chamber passages extending from each air chamber, respectively, to the air valve, and an exhaust passage extending from the air valve to atmosphere;

pump diaphragms extending across each air chamber, respectively, forming enclosed cavities;

a diffuser in the open diffuser cavity and including a block of porous material, a first surface on the air valve cylinder and a second, porous surface opposed to the first surface and being on the block of porous material, the exhaust passage extending through the air valve cylinder and being substantially normal to the first surface, the first surface and the second surface being spaced to provide a resistance to air flow at the exhaust passage which is substantially that of the resistance to air flow of the exhaust passage.

10. The air driven diaphragm pump of claim 9, the exhaust passage being at least as restrictive to air flow as the air chamber passages and the air valve.

11. The air driven diaphragm pump of claim 10, the exhaust passage being more restrictive to air flow than each of the air chamber passages and more restrictive to air flow than the air valve.

12. The air driven diaphragm pump of claim 9, the air valve further having a cylindrical bore in the valve cylinder closed at one end by the valve cylinder and an end cap closing the other end of the valve cylinder, the open diffuser cavity having retainer flanges extending into the cavity and an open end closed by the end cap.

13. The air driven diaphragm pump of claim 12 further comprising fasteners, the actuator housing and the air valve cylinder being held together by the fasteners, some of the fasteners also retaining the end cap to the air valve cylinder, the end cap having a plug with an O-ring thereon, the plug and O-ring closely mating with the valve cylinder, the fasteners being perpendicular to the extension of the plug into the valve cylinder.

14. An actuator for an air driven reciprocating device having air chambers with pump diaphragms extending across each air chamber, respectively, the actuator comprising an air valve;

air chamber passages extending from each air chamber, respectively, to the air valve;

an exhaust passage extending from the air valve to atmosphere, the exhaust passage being at least as restrictive as each of the air chamber passages and as the air valve to air flow.

15. The actuator of claim 14 further comprising a diffuser including a first surface of the air valve and a porous, second surface opposed to the first surface, the exhaust passage extending through and being substantially normal to the first surface, the first surface and the second surface being spaced to provide a resistance to air flow at the exhaust passage which is substantially that of the resistance to air flow of the exhaust passage.

16. The actuator of claim 15, the first surface and the second surface being spaced to provide a cylindrical orifice area substantially equal to the cross-sectional area of the exhaust passage.

17. An actuator for an air driven reciprocating device having air chambers with pump diaphragms extending across each air chamber, respectively, the actuator comprising an air valve;

air chamber passages extending from each air chamber, respectively, to the air valve;

an exhaust passage extending from the air valve to atmosphere;

a diffuser including a first surface and a second surface opposed to the first surface, at least one of the first surface and the second surface being porous, the exhaust passage extending through and being substantially normal to one of the first surface and the second surface, the first surface and the second surface being spaced to provide a resistance to air flow at the exhaust passage which is substantially that of the resistance to air flow of the exhaust passage.

18. The actuator of claim 17, the first surface and the second surface being spaced to provide a cylindrical orifice area substantially equal to the cross-sectional area of the exhaust passage.

19. An actuator for an air driven reciprocating device having air chambers with pump diaphragms extending across each air chamber, respectively, the actuator comprising an actuator housing having air chamber passages extending through the actuator housing from each air chamber, respectively, an air valve having a valve cylinder, an open diffuser cavity, a cylindrical bore in the valve cylinder closed at one end by the valve cylinder and an end cap closing the other end of the valve cylinder, the open diffuser cavity having retainer flanges extending into the cavity and an open end closed by the end cap, the air chamber passages extending to the air valve cylinder, an exhaust passage extending from the air valve cylinder to atmosphere;

a diffuser in the open diffuser cavity and including a block of porous material, a first surface on the air valve cylinder and a second, porous surface opposed to the first surface and being on the block of porous material, the exhaust passage extending through the air valve cylinder and being substantially normal to the first surface, the first surface and the second surface being spaced to provide a resistance to air flow at the exhaust passage which is substantially that of the resistance to air flow of the exhaust passage;

fasteners, the actuator housing and the air valve cylinder being held together by the fasteners, some of the fasteners also retaining the end cap to the air valve cylinder, the end cap having a plug with an O-ring thereon, the plug and O-ring closely mating with the valve cylinder, the fasteners being perpendicular to the extension of the plug into the valve cylinder.

20. The actuator of claim 19, the first surface and the second surface being spaced to provide a cylindrical orifice area substantially equal to the cross-sectional area of the exhaust passage.

21. The actuator of claim 19, the exhaust passage being at least as restrictive to air flow as the air chamber passages and the air valve.

* * * * *

UNITED STATES PATENT AND TRADEMARK OFFICE

CERTIFICATE OF CORRECTION

PATENT NO. : 5,607,290

DATED : March 4, 1997

INVENTOR(S) : Duncan

It is certified that error appears in the above-indentified patent and that said Letters Patent is hereby corrected as shown below:

In claim 4, line 4 (col. 6, l. 49), delete ";".

In claim 8, line 4 (col. 7, l. 10), delete ";".

In claim 14, line 2 (col. 7, l. 52), delete "pump".

In claim 17, line 2 (col. 8, l. 8), delete "pump".

In claim 19, line 2 (col. 8, l. 29), delete "pump".

Signed and Sealed this

Twenty-ninth Day of July, 1997

Bruce Lehman

*Attest:*

BRUCE LEHMAN

*Attesting Officer*

*Commissioner of Patents and Trademarks*